US008882336B1

(12) United States Patent
Wolford

(10) Patent No.: US 8,882,336 B1
(45) Date of Patent: Nov. 11, 2014

(54) HYDRO-BLENDER

(75) Inventor: Glen Michael Wolford, Corinth, TX (US)

(73) Assignee: McClinton Energy Group, LLC, Odessa, TX (US)

( * ) Notice: Subject to any disclaimer, the term of this patent is extended or adjusted under 35 U.S.C. 154(b) by 142 days.

(21) Appl. No.: 13/595,971

(22) Filed: Aug. 27, 2012

Related U.S. Application Data

(60) Provisional application No. 61/528,125, filed on Aug. 26, 2011.

(51) Int. Cl.
*B28C 7/04* (2006.01)

(52) U.S. Cl.
USPC ..... 366/34; 366/35

(58) Field of Classification Search
CPC .. B28C 7/0477; B28C 7/0481; B28C 7/0486; B28C 7/10; B28C 9/0454
USPC ..... 366/33–35, 37, 38, 40, 60, 61, 10
See application file for complete search history.

(56) References Cited

U.S. PATENT DOCUMENTS

| | | | | | |
|---|---|---|---|---|---|
| 4,159,180 | A * | 6/1979 | Cooper et al. | ..... | 366/26 |
| 4,239,396 | A * | 12/1980 | Arribau et al. | ..... | 366/2 |
| 4,685,375 | A * | 8/1987 | Ross et al. | | |
| 4,789,170 | A * | 12/1988 | Reber | ..... | 280/838 |
| 5,044,819 | A * | 9/1991 | Kilheffer et al. | ..... | 404/72 |
| 5,718,508 | A * | 2/1998 | Williams | ..... | 366/138 |
| 5,893,639 | A * | 4/1999 | Tetoldini | ..... | 366/18 |
| 6,193,402 | B1 * | 2/2001 | Grimland et al. | ..... | 366/14 |
| 6,568,842 | B1 * | 5/2003 | Murray | ..... | 366/137 |
| 2003/0161212 | A1 * | 8/2003 | Neal et al. | ..... | 366/10 |
| 2010/0044049 | A1 * | 2/2010 | Leshchyshyn et al. | .... | 166/308.1 |

* cited by examiner

*Primary Examiner* — Charles Cooley
*Assistant Examiner* — Marc C Howell
(74) *Attorney, Agent, or Firm* — K & L Gates LLP

(57) ABSTRACT

A hydro-blender for mixing base fluids and particulates for use in pumping can include a transport device. The hydro-blender can also include a liquid tank connected with the transport device. An inlet manifold can be located within the liquid tank for receiving fluid from one or more fluid sources. The inlet manifold can be in fluid communication with one or more fluid sources. The hydro-blender can also include a mixing tub in communication with one or more hoppers via one or more augurs.

12 Claims, 6 Drawing Sheets

HYDRO-BLENDER

CROSS REFERENCE TO RELATED APPLICATIONS

The present application claims priority to and the benefit of U.S. Provisional Patent Application Ser. No. 61/528,125 filed on Aug. 26, 2011, entitled "HYDRO-BLENDER" which is incorporated herein in its entirety.

FIELD

The present embodiments generally relate to a hydro-blender for mixing base fluids and particulates for use in fracturing operations.

BACKGROUND

A need exists for a hydro-blender that includes an integrated hydration and blending system.

A further need exists for a hydro-blender that has a small footprint.

The present embodiments meet these needs.

BRIEF DESCRIPTION OF THE DRAWINGS

The detailed description will be better understood in conjunction with the accompanying drawings as follows.

Figure 1:
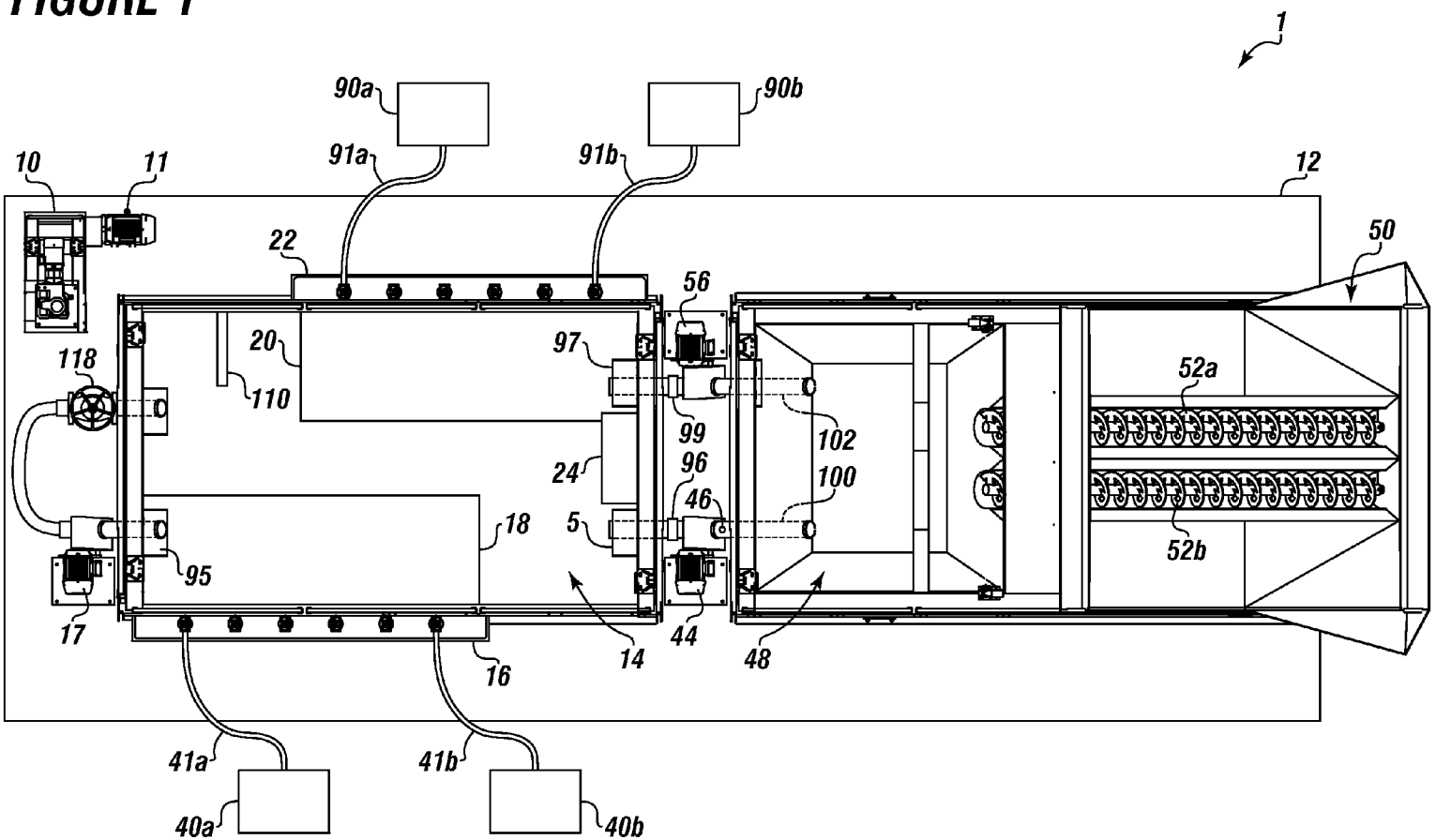
FIG. 1 depicts a schematic of an embodiment of the hydro-blender having a rectangular mixing tub.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a hydro-blender for mixing base fluids and particulates for use in pumping. Pumping can be for fracturing operations, suction, or similar operations. The particulates can be sand, gravel, granular material, or combinations thereof. The fluid can be water, salt water, chemical slurry, gel slurry, other fluids, or combinations thereof.

The hydro-blender can include a liquid tank. The liquid tank can have an inner cavity. The inner cavity can have a volume of from about 50 barrels to about 200 barrels. The liquid tank can have an inlet manifold disposed therein.

The liquid tank can be configured to provide a buffer between the fluid sources and the mixing tub and hydration to one or more fluid combinations. A buffer can be a volume of fluid held by the liquid tank between the mixing tub and one or more fluid sources. The hydration can be provided by agitation within the tank allowing gels or other substances to be hydrated by the fluid in the inner cavity of the liquid tank.

To aid with hydration the liquid tank can have one or more baffles located in the inner cavity. The baffles can be connected with the walls of the liquid tank, formed on the walls of the liquid tank, or combinations thereof.

The inlet manifold can be configured to receive fluid from one or more fluid sources. For example, the inlet manifold can have a plurality of inlet ports configured to connect to one or more conduits that are in fluid communication with one or more fluid sources. The conduits can be one or more hoses, pipes, channels, or the like. The inlet ports can have differing flow areas. For example, a first inlet port can have a flow area of 10 square inches and a second inlet port can have a flow area of 15 square inches.

The inlet manifold can be in fluid communication with an inlet of a first pump. The first pump can be any pump. The first pump can have an outlet in fluid communication with the inner cavity of the liquid tank. The first pump can provide a flow rate through the inlet manifold of about 10 barrels per minute to about 120 barrels per minute.

The inlet manifold can have an inner surface. A protective coating can be disposed on the inner surface of the inlet manifold. The protective coating can inhibit, slow, or prevent, internal wear of the inlet manifold due to corrosion or the like.

In one or more embodiments, an inlet spout can be in fluid communication with an outlet of the first pump and provide fluid to the inner cavity of the liquid tank. The inlet spout can be a nozzle, a diffuser, or the like. For example, the inlet spout can be a nozzle to provide increased velocity to the fluid as it enters into the inner cavity.

The inner cavity can have an outlet. The outlet can be a port disposed on a lower portion of the liquid tank. In one or more embodiments, the outlet can be a port formed in the lower portion of the liquid tank. The outlet can be in fluid communication with an inlet of a second pump. Accordingly, the outlet can allow fluid in the liquid tank to pass out of the inner cavity to a second pump. The second pump can be any pump. The second pump can provide a flow rate through the outlet of about 10 barrels per minute to about 120 barrels per minute.

The outlet of the second pump can be in fluid communication with a mixing tub. The mixing tub can be configured to agitate the fluid therein allowing the fluid to mix with a particulate provided to the mixing tub. The agitation can be performed using one or more paddles, pumps, cyclones, the like, or combinations thereof.

A third pump can have an inlet in fluid communication with the mixing tub. The third pump can have an outlet in fluid communication with a discharge manifold that is integrated with the liquid tank. The discharge manifold can be formed in the inner cavity, secured to the liquid tank, secured within the inner cavity, or otherwise integrated with the liquid tank. The discharge manifold can connect with a plurality of discharge flow paths that are configured to provide fluid to downhole operations. The discharge flow paths can be one or more tubular members, hoses, channels, the like, or combinations thereof.

Figure 3:
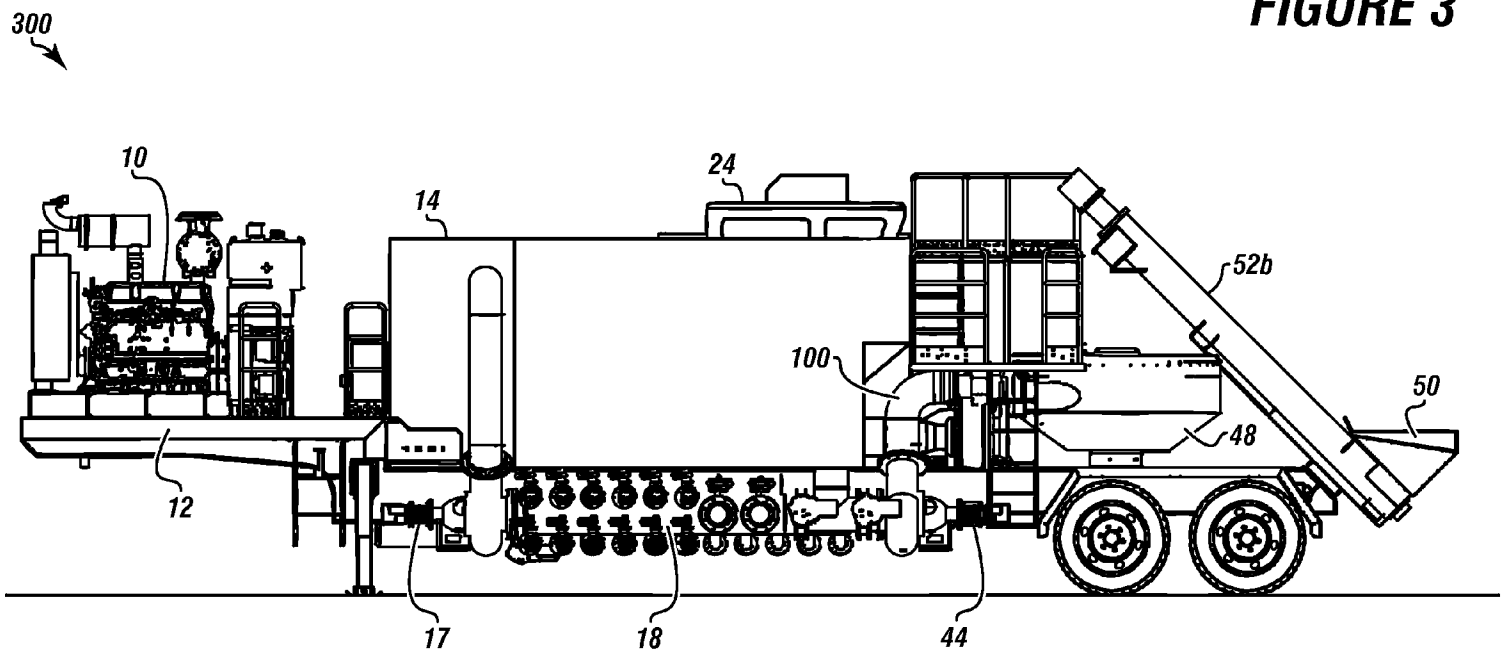
FIG. 3 depicts a schematic of another embodiment of a trailer mounted hydroblender, with the control station in an extended position.
Figure 4:
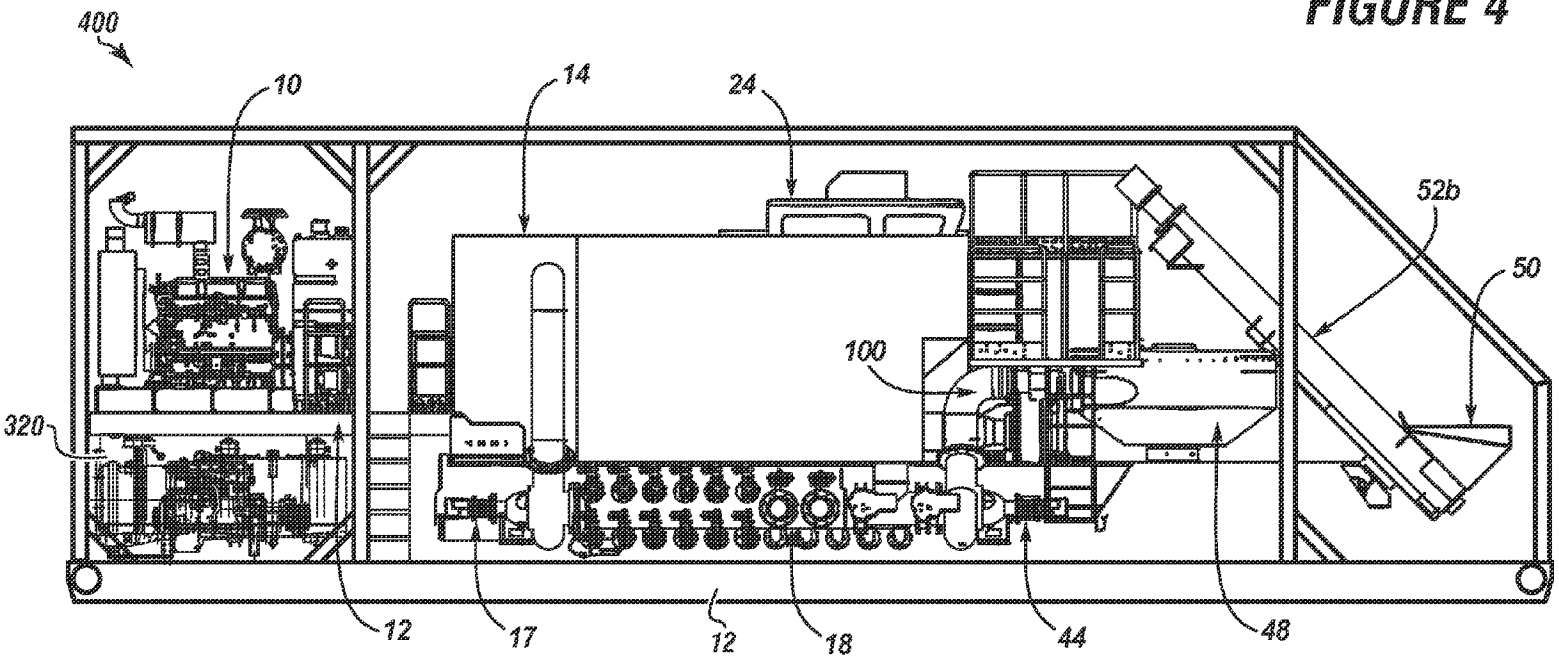
FIG. 4 depicts a perspective view of the transport device, with the control station in an extended position.

The hydro-blender can include a control station configured to be retracted (FIGS. 5 and 6) and extended (FIGS. 3 and 4). The control station can be configured to control and monitor the first pump, the second pump, the third pump, the mixing tub, other components of the hydroblender, or combinations thereof. For example, the control station can have a processor in communication through one or more forms of telemetry with one or more flow measuring devices, valves, pumps, or combinations thereof. As such the control station can be configured to control the pumps based on acquired data from one or more flow measuring devices integrated into the hydro-blender.

In one or more embodiments, the control station can be in communication with a first flow measuring device between the inlet manifold and the liquid tank, a second flow measuring device between the outlet of the second pump and the mixing tub, a third flow measuring device between the third pump outlet and the discharge manifold, and a density measuring device between the third pump outlet and the discharge manifold. The control station can receive data acquired by each measuring device and control flow rates through the pumps in response to the acquired data.

Figure 5:
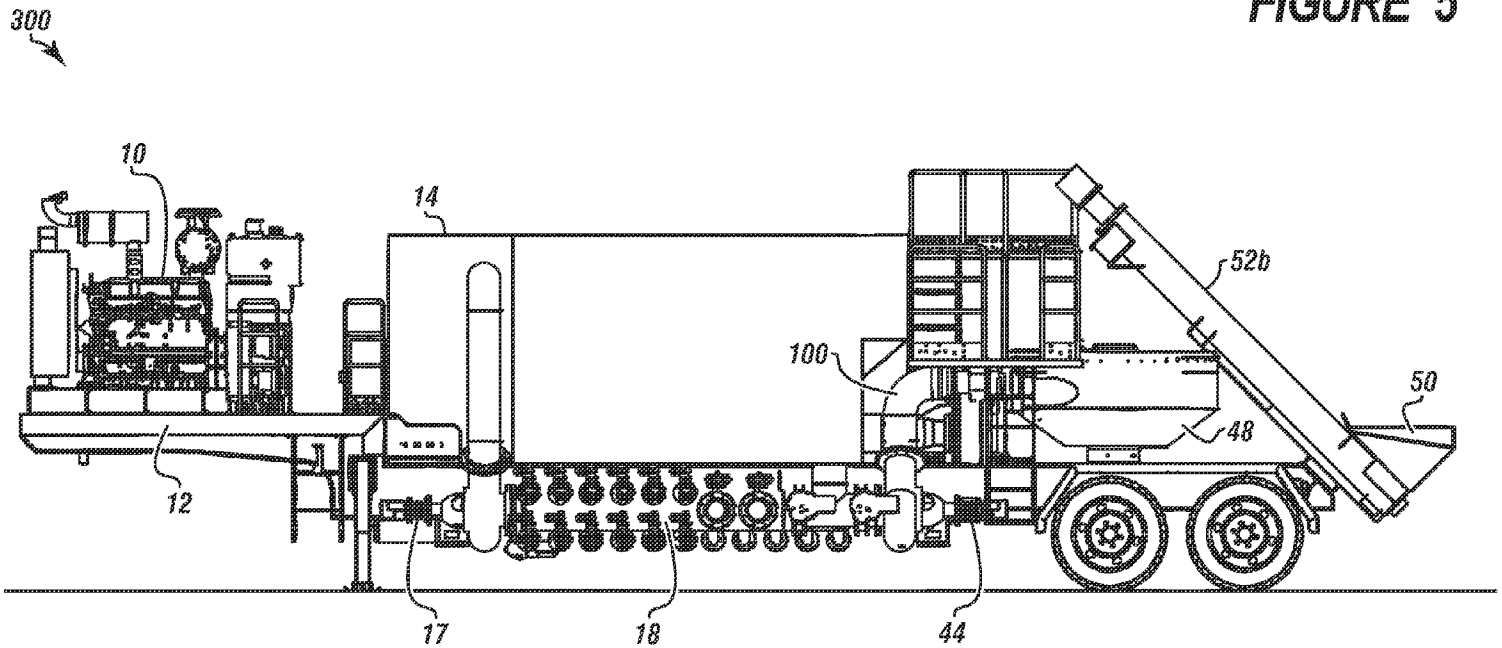
FIG. 5 depicts a schematic of the embodiment of a trailer mounted hydroblender shown in FIG. 3, with the control station in a retracted position.
Figure 6:
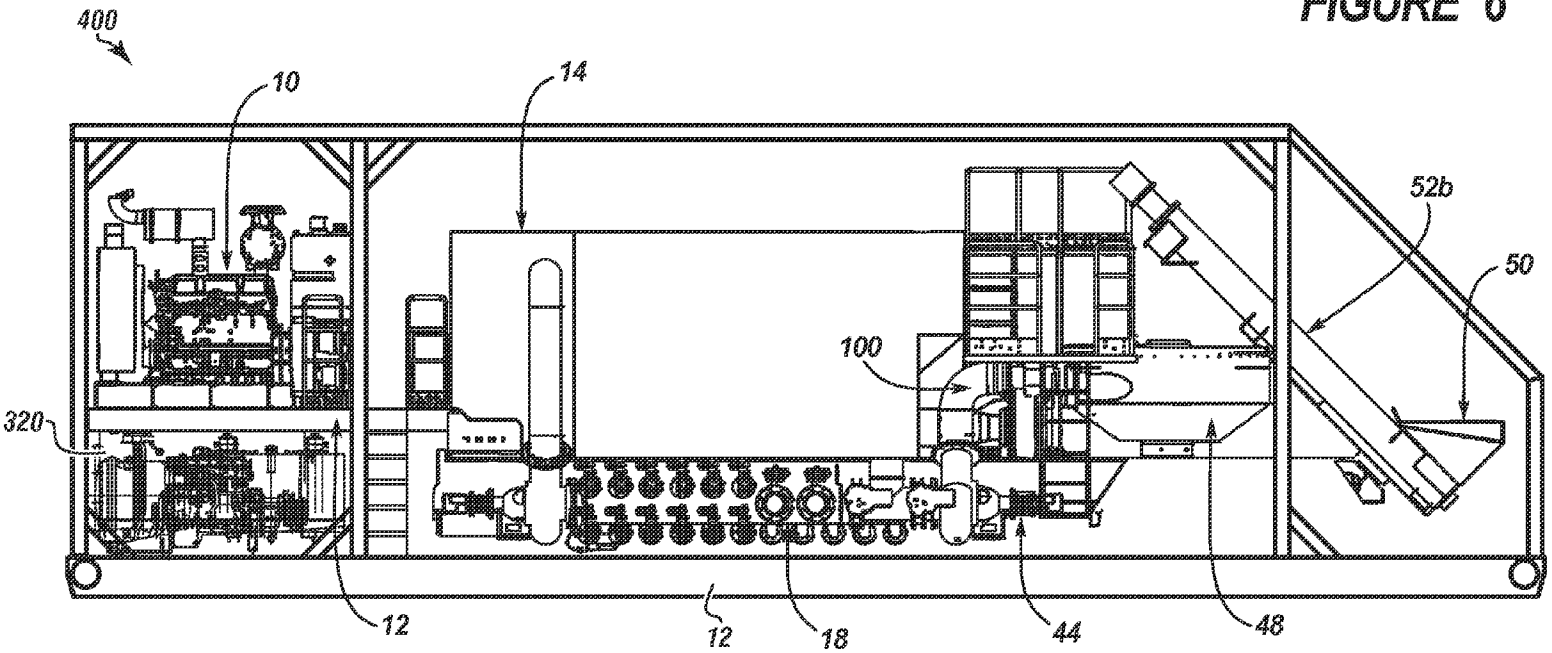
FIG. 6 depicts a perspective view of the transport device shown in FIG. 4, with the control station in a retracted position.

In one or more embodiments, the control station can be configured to rest within the inner cavity of the liquid tank when in a retracted position (FIGS. 5 and 6). In addition, when the control station is in an extended position, the control station can be elevated to provide a clear view of the mixing tub and the liquid tank (FIGS. 3 and 4).

The hydro-blender can also include a deck engine for driving a hydraulic power source, and the hydraulic power source can power the pumps, lifting mechanisms, augurs, the mixing tub, other components integrated with the hydro-blender, or combinations thereof.

One or more chemical injection ports can be located between the second pump outlet and the mixing tub. The chemical injection ports can be configured to provide one or more chemicals to the fluid. The chemicals can be acids, surfactants, gels, ph reducers, biocides, other additives, or combinations thereof.

In one or more embodiments, the pumps, the mixing tub, and the liquid tank can be located on a transport device. The transport device can be a skid, a floating vessel, a trailer, other portable platforms, or combinations thereof.

A containment tray can be connected with the transport device. The containment tray can be configured to capture any fluids, particulates, or combinations thereof escaping from the liquid tank, mixing tub, or combinations thereof.

A first manifold containment tray can be connected with the inlet manifold, and a second manifold containment tray can be connected with the discharge manifold. The first manifold containment tray can be configured to slide out from the inlet manifold. And the second manifold containment tray can be configured to slide out from the discharge manifold. The manifold containment trays can be configured to capture any fluid, particulate, or combinations thereof escaping from the manifolds and ports.

In one or more embodiments, the containment trays can include one or more outlets. The outlets can be configured to connect to a hose, a pipe, the like, or combinations thereof. The hose, the pipe, the like, or combinations thereof can be in communication with a pump. The pump can be operated to remove any fluid or waste in the containment trays.

Turning now to the Figures, FIG. 1 depicts a schematic of an embodiment of the hydro-blender having a rectangular mixing tub.

The hydro-blender 1 can include a transport device 12. The transport device 12 can have one or more liquid tanks 14, one or more mixing tubs 48, one or more hoppers 50, one or more augurs 52*a* and 52*b*, and one or more pumps 17, 44, and 56 connected therewith.

The liquid tank 14 can have an inlet manifold 18 integrated therewith. The inlet manifold 18 can have a first manifold containment tray 16 adjacent thereto. The first manifold containment tray 16 can be movably connected with the transport device 12 and can be moved from a retracted position during transportation of the hydro-blender 1 to an extended position during the operation of the hydro-blender 1.

The first manifold containment tray 16, in the extended position, can extend out and capture fluid escaping from supply lines 41*a* and 41*b* or the inlet manifold 18 as the fluid is transported from fluid sources 40*a* and 40*b* to the inlet manifold 18.

The liquid tank 14 can further have a discharge manifold 20 integrated therewith. The discharge manifold 20 can have a second manifold containment tray 22 adjacent thereto. The second manifold containment tray 22 can be configured to extend during the operation of the hydro-blender 1 and retracted during transportation of the hydro-blender 1. The second manifold containment tray 22, in an extended position, can be configured to capture fluids, particulate, or combinations thereof, escaping from discharge lines 91*a* and 91*b* as fluid from the discharge manifold 20 is transferred to one or more end uses 90*a* and 90*b*.

The liquid tank 14 can be in fluid communication with the mixing tub 48 via a second pump 44. The inlet of the second pump 44 can be in fluid communication with the inner cavity of the liquid tank, and the outlet of the second pump 44 can be in fluid communication with the mixing tub 48.

The mixing tub 48 can also be in communication with the hopper 50 via the augurs 52*a* and 52*b*. The hopper 50 and augurs 52*a* and 52*b* can be configured to move, for example on a rail system, from an operation position to a storage and transportation position. For example, one or more hydraulic cylinders can be used to raise and lower the hopper 50 and the augurs 52*a* and 52*b*.

A control station 24 can be configured to communicate with a drive engine 10, a hydraulic power source 11, the pumps 17, 44, and 56, the mixing tub 48, a plurality of valves configured to control flow throughout the hydro-blender, or combinations thereof to control the operation of the hydro-blender 1.

In operation the fluid sources 40*a* and 40*b* can be connected with the inlet manifold 18. The inlet manifold 18 can be operatively connected to an inlet of a first pump 17. The first pump 17 can provide suction to the inlet manifold 18 and move the fluid from the fluid sources 40*a* and 40*b* through the inlet manifold 18.

The outlet of the first pump 17 can be in fluid communication with the inner cavity of the liquid tank 14. As such, fluid passing through the inlet manifold 18 and the first pump 17 can be deposited in the liquid tank 14. For example, an inlet spout 118 in communication with the outlet of the first pump 17 can provide flow into the liquid tank 14.

The fluid in the liquid tank 14 can be transferred through an outlet 5 to the mixing tub 48 via the second pump 44 and first flow line 100.

As the fluid from the liquid tank 14 is transferred to the mixing tub 48, one or more chemical injection ports 46 can be used to inject substances into the fluid.

In the mixing tub 48, particulates from the hopper 50 can be provided to the mixing tub 48 via the augurs 52*a* and 52*b*. The mixing tub 48 can have agitators for mixing the particulate with the fluid in the mixing tub.

The mixed fluid and particulates can form a slurry, and the slurry can be transferred from the mixing tub 48 to the discharge manifold 20 via a third pump 56 and second flow line 102. The discharge manifold 20 can be in fluid communication with the end uses 90*a* and 90*b* via discharge lines 91*a* and 91*b*.

A first flow measuring device 95, such as a flow meter, can be disposed between the inlet manifold 18 and the first pump 17. The first flow measuring device 95 can be configured to acquire data related to the flow rate of fluid exiting the inlet manifold and relay the acquired data to the control station 24.

A second flow measuring device 96 can be used to measure flow in the first flow line 100. The second flow measuring device 96 can acquire data related to the flow rate of fluid entering the mixing tub 48. The second flow measuring device 96 can relay the acquired data to the control station 24.

A third flow measuring device 97 can be located between the discharge manifold 20 and the third pump 56. The third flow measuring device 97 can acquire data related to the flow rate of fluid from the mixing tub 48 to the discharge manifold 20. The third flow measuring device 97 can communicate the acquired data to the control station 24.

A density measuring device 99 can be located between the discharge manifold 20 and the third pump 56. The density measuring device 99 can acquire data related to the density of fluid.

One or more baffles 110 can be located in the inner cavity of the liquid tank 14. The baffles can be staggered or other wise located throughout the inner cavity to provide enhanced hydration.

Figure 2:
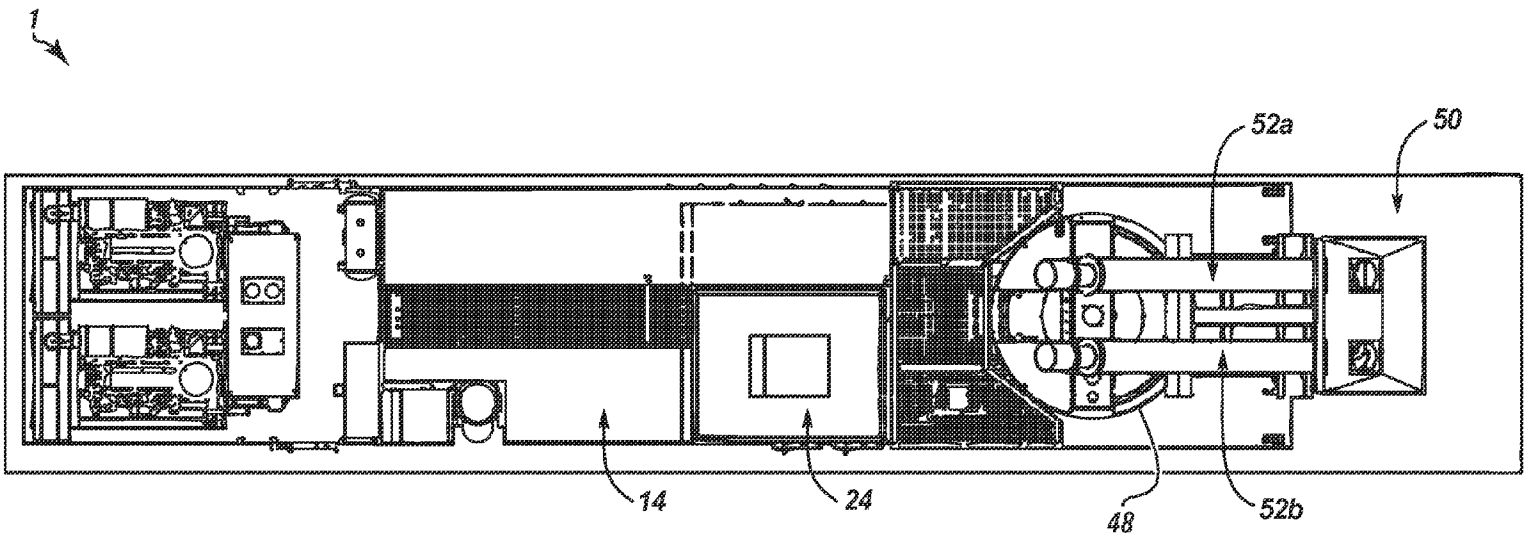
FIG. 2 depicts a top view of a hydro-blender having a circular mixing tub.

FIG. 2 depicts a top view of a hydro-blender having a circular mixing tub.

In one or more embodiments of the hydro-blender 1, the mixing tub 48 can be circular.

FIG. 3 depicts a schematic of another embodiment of a trailer mounted hydro-blender. The trailer mounted hydro-blender can include all of or some of the components of one or more embodiments of the hydro-blenders disclosed herein.

The trailer mounted hydro-blender 300 can be connected with the transport device 12. The trailer mounted hydro-blender 300 can include the drive engine 10, the first pump 17, the second pump 44, the liquid tank 14, the control station 24, one or more augurs, such as augur 52*b*, the hopper 50, and the mixing tub 48.

The mixing tub 48 can be in fluid communication with the liquid tank 14 via the first flow line 100. The inlet manifold 18 can also be in communication with the liquid tank 14.

FIG. 4 depicts a perspective view of the transport device.

A skid mounted hydro-blender 400 can be located on the transport device 12. The transport device 12 can be a skid. The transport device 12 can have a containment tray for receiving fluid that may leak from the equipment on the skid.

The transport device 12 can also include a fire suppression system 320. The fire suppression system 320 can be used to suppress fires that may develop on the transport device 12.

While these embodiments have been described with emphasis on the embodiments, it should be understood that within the scope of the appended claims, the embodiments might be practiced other than as specifically described herein.

What is claimed is:

1. A hydro-blender for mixing base fluids and particulates for pumping, wherein the hydroblender comprises:

a. a transport device;

b. a liquid tank connected with the transport device, wherein the liquid tank comprises an inner cavity;

c. an inlet manifold for receiving fluid from one or more fluid sources and in fluid communication with the inner cavity of the liquid tank;

d. a first pump in fluid communication with the inlet manifold and the inner cavity of the liquid tank;

e. a mixing tub in fluid communication with the liquid tank via a second pump;

f. a discharge manifold in fluid communication with the mixing tub via a third pump;

g. a control station configured to be retracted and extended, wherein the control station is configured to control and monitor the first pump, the second pump, the third pump, and the mixing tub, and wherein the control station is connected with the transport device, the control station is configured to rest within the inner cavity of the liquid tank when in a retracted position, and when the control station is an extended position, the control station is elevated to provide clear view of the mixing tub and the liquid tank; and h. a hopper connected with the transport device, wherein the hopper is in fluid communication with the mixing tub via one or more augurs.

2. The hydro-blender of claim 1, wherein the inlet manifold comprises a plurality of inlet ports.

3. The hydro-blender of claim 2, wherein the plurality of inlet ports have varying flow areas.

4. The hydro-blender of claim 1, wherein the inlet manifold comprises a protective coating disposed on an interior thereof to prevent internal wear.

5. The hydro-blender of claim 1, further comprising a first flow measuring device between the inlet manifold and the liquid tank, wherein the first flow measuring device is in communication with the control station.

6. The hydro-blender of claim 1, wherein the liquid tank has a baffle located in the inner cavity thereof.

7. The hydro-blender of claim 6, wherein the baffle is built into at least a portion of one of the walls of the liquid tank.

8. The hydro-blender of claim 1, further comprising a second flow measuring device between the liquid tank and the mixing tub, wherein the second flow measuring device is in communication with the control station.

9. The hydro-blender of claim 1, further comprising a third flow measuring device between the liquid tank and the discharge manifold, wherein the third flow measuring device is in communication with the control station.

10. The hydro-blender of claim 1, further comprising a density measuring device between the liquid tank and the discharge manifold, wherein the density measuring device is in communication with the control station.

11. The hydro-blender of claim 1, further comprising a chemical injection port between the first pump and the second pump.

12. The hydro-blender of claim 1, further comprising a first flow measuring device between the inlet manifold and the liquid tank, a second flow measuring device between the liquid tank and the mixing tub, a third flow measuring device between the liquid tank and the discharge manifold, and a density measuring device between the liquid tank and the discharge manifold, wherein the first, second and third flow measuring devices and the density measuring device are in communication with the control station, and the control station controls the first, second and third pumps in response to data acquired from the first, second and third flow measuring devices and the density measuring device.

* * * * *